United States Patent [19]

Curry

[11] 4,385,708

[45] May 31, 1983

[54] TAMPER PROOF LID

[76] Inventor: John J. Curry, 2 S. 752 Theresa Ct., Oak Brook, Ill. 60521

[21] Appl. No.: 271,944

[22] Filed: Jun. 9, 1981

Related U.S. Application Data

[63] Continuation-in-part of Ser. No. 85,975, Oct. 18, 1979, Pat. No. 4,322,010.

[51] Int. Cl.[3] ..... B65D 41/46

[52] U.S. Cl. ..... 215/256; 215/254

[58] Field of Search ..... 215/256, 254; 220/270

[56] References Cited

U.S. PATENT DOCUMENTS

| | | | |
|---|---|---|---|
| 3,247,994 | 4/1966 | Fuglsang-Madsen | 215/321 |
| 3,415,404 | 12/1968 | Robinson | 215/256 |
| 3,622,028 | 11/1971 | Lohrer | 215/321 X |
| 3,856,171 | 12/1974 | Rossi | 215/321 X |

*Primary Examiner*—Donald F. Norton

*Attorney, Agent, or Firm*—Charles A. Brown

[57] ABSTRACT

A tamper proof lid which includes a crown having means for interlocking with a container neck finish. The crown has a depending skirt which incorporates a frangible portion and there is a handle which is secured to the frangible skirt portion generally as a continuation thereof and disposed radially outwardly of the adjacent part of the skirt. There is a rupturable webbing extending between the handle and the skirt which, when broken, indicates that the lid has been tampered with. The interlock between the crown and a container neck finish is sufficient to retain the crown in place under all conditions. The depending skirt initially provides for a hermetic seal. The lid is preferably formed of a relatively rigid material, such as polypropylene, which makes it virtually impossible to remove the crown from an associated container neck finish. The handle, once it initiates rupture of the skirt, is required to effect an upward prying and peeling of the crown from the associated container neck finish.

23 Claims, 10 Drawing Figures

TAMPER PROOF LID

This application is a continuation-in-part of my copending application Ser. No. 85,975 filed Oct. 18, 1979, entitled TAMPER PROOF LID, and now U.S. Pat. No. 4,322,010; issued on Mar. 30, 1982.

This invention relates in general to new and useful improvements in tamper proof lids or closure caps, and more particularly to lids which tightly fit an associated container effecting a good seal while at the same time being removable by means of an associated handle. The lids or closure caps in accordance with this invention are particularly adapted for resealing.

Tamper proof lids for containers are well known and when lids are of the crown type, are normally formed of low density polyethylene. This is generally the softest of the commercially available polyethylenes. Such a material has been required in the past because no suitable means have been provided for removing a more rigid material lid, such as polypropylene. Polypropylene lids are particularly adaptable for forming a very tight seal with a container neck finish, particularly when the container is formed of a deformable plastic material whereby an intimate and positive seal may be obtained between the lid and the container neck finish.

In accordance with this invention, it is proposed to provide a simple and inexpensive tamper proof lid or closure cap of the crown type which may be readily snapped in place on a container neck finish and which is provided with a depending skirt which initially functions to form a hermetic seal with the lower portion of the container neck finish and which has a frangible portion to which there is secured a handle whereby the handle may be utilized to initiate rupture of the skirt and thereafter to utilize the frangible skirt portion to effect an upwardly and radially outwardly prying action on the crown to initiate removal of the crown from the container neck finish.

In accordance with this invention, the skirt of the lid is provided with an axial weakening line along which the skirt may be ruptured so as to define a frangible skirt portion. The frangible skirt portion is provided remote from the axial weakening line with a reinforcement which is specifically configurated so as to, when an upwardly and radially outwardly directed force is applied to the frangible skirt portion by means of the handle, effect an upwardly and radially outward bowing of the crown and to effect a peeling of the crown from the container neck finish.

In accordance with this invention, the frangible skirt portion may either be a portion of the skirt immediately adjacent the axial weakening line, or the skirt may be provided at its connection with the body of the crown with a circumferentially extending line of weakness wherein a limited portion of the skirt may be torn from the crown so as to provide a relatively long strap which permits a firm gripping of either the handle or the frangible skirt portion, or both, so as to effect the peeling of the crown from the associated container neck finish.

The handle is an integral part of the frangible skirt portion and extends circumferentially beyond the axial weakening line and is spaced radially outwardly of the adjacent part of the skirt. The handle is connected to the adjacent part of the skirt by a frangible web which indicates when the lid has been tampered with.

The handle is provided with a beam like connection with the frangible skirt portion so that when the handle is pulled, a force is primarily applied to the lower part of the skirt adjacent the axial line of weakening so as to apply a radially outwardly and upwardly directed force on the skirt along the axial line of weakening so as to initiate rupture of the skirt there along.

Another feature of the invention is the relationship of the lid or closure cap with respect to a container neck finish wherein the lid may be easily applied but wherein the relative diameters of the lid crown and the neck finish crown bead is such that when the lid is applied to the container neck finish, the lid bead is radially outwardly expanded which results in an associated locking bead of the lid being drawn axially towards the end panel of the lid so as to compressively engage the locking bead with the underside of a locking shoulder on the container neck finish.

A still further feature of the invention is the formation of the lid or closure cap with a generally cylindrical skirt which is of a diameter less than the adjacent portion of the container neck finish wherein when the lid is applied to the container neck finish, the skirt or lid is radially outwardly expanded and has an interference fit with the adjacent neck finish portion.

A lid formed in accordance with the invention uniquely differs from other commercially available prior art lids because it:

1. can be made of stiffer, harder and tougher materials, i.e. less forgiving materials.
2. is removable in one piece.
3. has a double hermetic seal with a companion container neck finish.
4. has easy pick-up by the container neck finish during sealing.
5. seats on a container neck finish ideally for final sealing.
6. is virtually impossible to remove by hand grip even if the whole bottom skirt is removed.
7. reseals with the container neck finish, holding the same integrity as the original seal.

With the above, and other objects in view that will hereinafter appear, the nature of the invention will be more clearly understood by reference to the following detailed description, the appended claims and the several views illustrated in the accompanying drawings.

Figure 1:
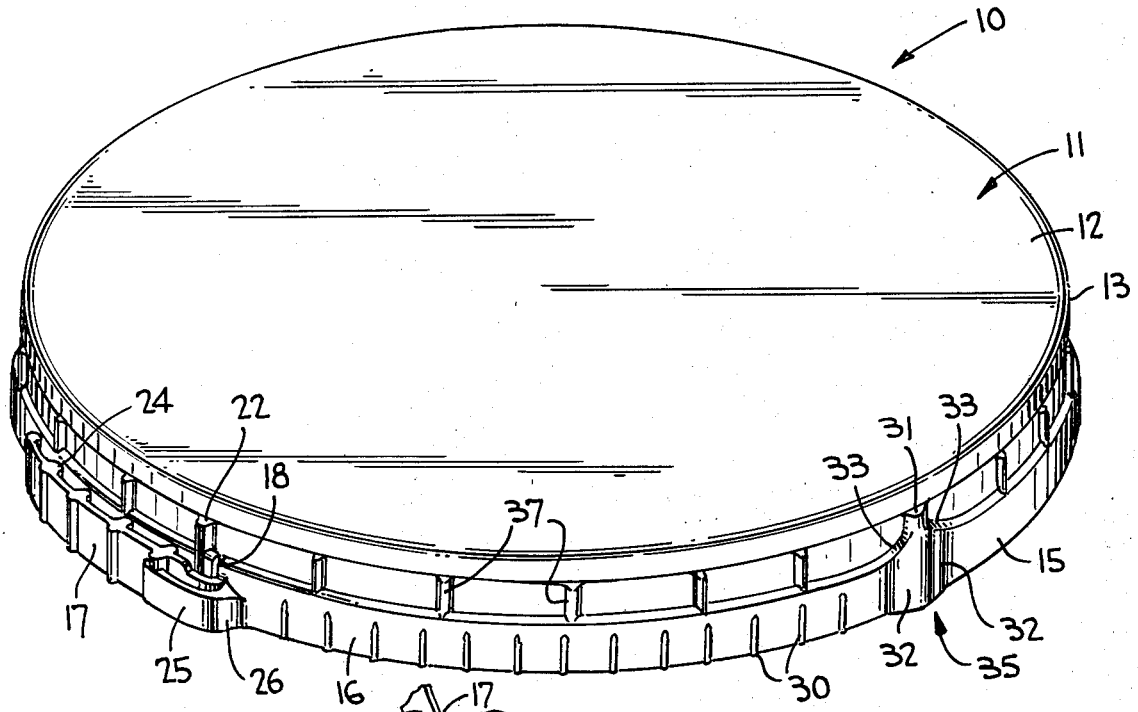
FIG. 1 is a top perspective view of a lid formed in accordance with this invention wherein the frangible skirt portion is defined in part by a circumferentially extending line of weakness.
Figure 6:
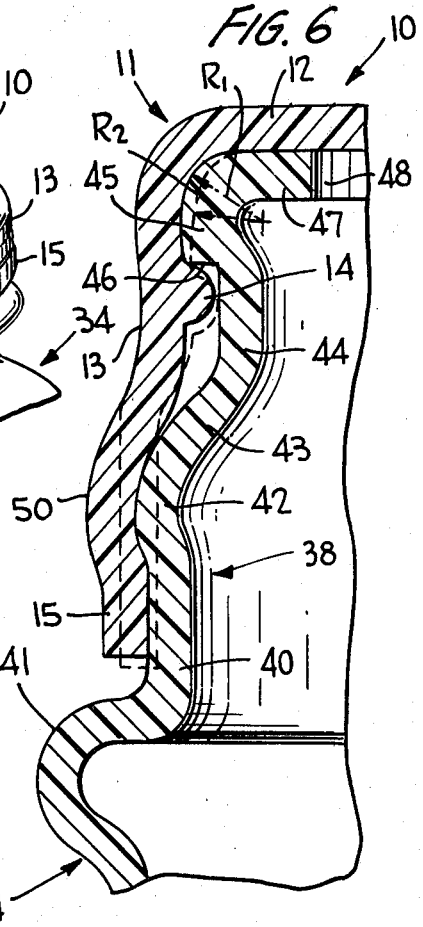
FIG. 6 is an enlarged fragmentary vertical sectional view taken through the container neck finish and shows the specific deformation of the lid.

Referring now to the drawings in detail, it will be seen that there is illustrated in FIG. 1 a preferred embodiment of the tamper proof lid or closure cap, generally designated by the reference numeral 10. The tamper proof lid 10 includes a crown 11 which is formed of a circular end panel 12 and a depending annular body 13. The body 13, as is best shown in FIG. 6, is provided with a radially inwardly directed locking beam 14 which, in certain embodiments of the invention, may be in the form of circumferentially spaced lugs. It is to be understood that the locking bead 14 is intended for interlocking with a neck finish of a container in a manner to be described hereinafter.

The lid 10 also includes a depending skirt 15 which is of a larger diameter than the crown body 13 and depends from the crown body 13 below the locking bead 14. The skirt 15 includes a frangible skirt portion 16 which will be specifically described in detail hereinafter.

A handle or actuating lever 17 is secured to the frangible skirt portion 16 as an extension thereof. The handle 17 is used as a lever to cause rupture of the frangible skirt portion relative to the crown body 13 and the remainder of the skirt 15. The rupture of the frangible skirt portion 16 will be described in greater detail hereinafter.

Figure 7:
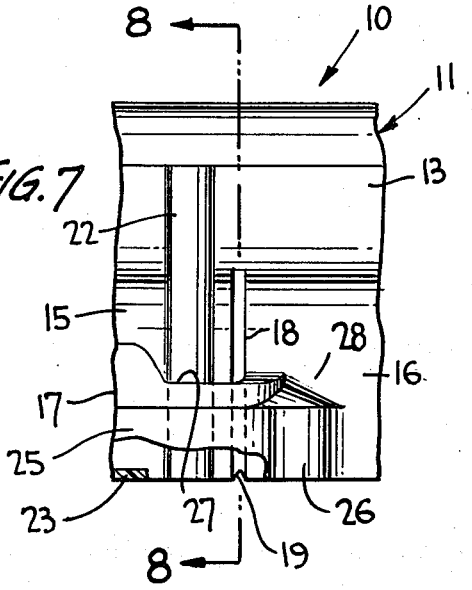
FIG. 7 is an enlarged fragmentary elevational view of the lid in the area of the axial line of weakening and shows the specific details thereof.
Figure 8:
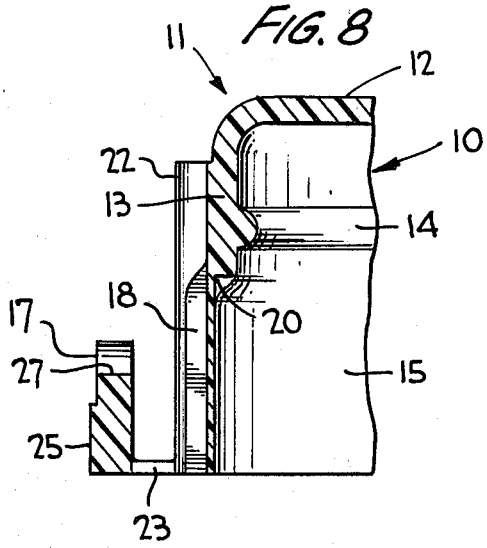
FIG. 8 is a vertical sectional view taken generally along the line 8—8 of FIG. 7 and shows further the specific details of the lid.

The frangible skirt portion 16 is defined by an axial score or weakening line 18 best shown in FIGS. 7 and 8. It is to be noted that the weakening line 18 is formed in the exterior of the skirt 15.

The frangible skirt portion 16 is also defined by a circumferential weakening line 20 which begins at the upper end of the weakening line 18 and extends circumferentially through an extent on the order of about 45 degrees. The circumferential weakening line 20, as is best shown in FIG. 8, is defined by the skirt 15 being radially outwardly offset relative to the crown body 13 in the manner best shown in FIG. 8.

Figure 9:
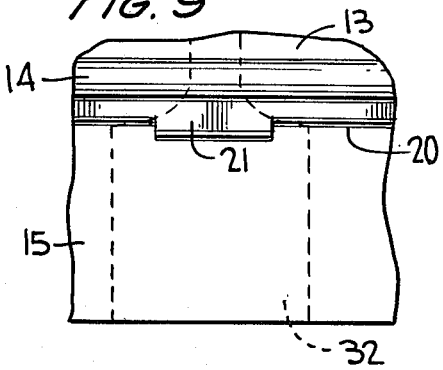
FIG. 9 is a fragmentary internal elevational view of the lid in the area of the termination of the circumferential line of weakening and shows the reinforcement of the lid.

In order to limit the circumferential effective extent of the line of weakening 20, as is best shown in FIG. 9, there is provided on the interior of the lid 10 in circumferential alignment with the line of weakening 20 a reinforcing rib or bead 21. The rib or bead 21 extends circumferentially and generally bridges the skirt 15 and the crown body. It will be seen that the reinforcing rib or bead 21 prevents tearing of the skirt 15 relative to the crown body beyond the intended point.

In order to assure the initial rupture of the skirt 15 along the axial line of weakening 18, the skirt has a notch 19 at the lower end of the line 18 and the lid 10 is provided with an external axial reinforcement or rib 22 as is best shown in FIGS. 7 and 9. The rib 22 is disposed to the side of the weakening line 18 remote from the frangible skirt portion 16 and starts at the bottom of the skirt 15 and extends substantially the full height of the crown body 13. It thus will be seen that, with reference to FIG. 7, the skirt 15 is relatively stiff to the left of the weakening line 18 while the skirt portion 16 is free to flex to the right of the weakening line 18, thus permitting initiating of rupture of the skirt 15 along the weakening line 18 at the bottom of the skirt.

Reference is now made to the specific details of the handle 17. First of all, it will be seen that the handle 17 is a continuation of the frangible skirt portion 16 and is disposed in radially spaced relation with respect to an adjacent part of the skirt 15 to the left of the line of weakening 18. A lower part of an intermediate portion of the handle 17 is connected to the outer surface of the skirt 15 by a thin web 23. The connection of the web 23 to the skirt 15 is greater than that to the handle 17 so that when the handle 17 is pulled radially away from the skirt 15, the connection between the handle 17 and the web 23 will rupture leaving the web 23 adhered to the skirt 15.

It is to be understood that when the handle 17 is displaced radially outwardly from the skirt 15, even if the lid is not removed from an associated container, the web 23 will displace a severed condition so as to clearly indicate that the tamper proof lid 10 has been tampered with.

With reference to FIG. 1, it will be seen that the handle 17 is provided with internal and external axial ribs or teeth 24 which, after the rupture of the connection between the handle 17 and the web 23 has been initiated, serves to facilitate the gripping of the handle 17.

It will also be apparent that there is a special connection between the handle 17 and the frangible skirt portion 16. It will be seen that there is provided a beam 25 of an angular configuration in plan with the beam 25 being disposed radially outwardly of the handle 17 and including a leg 26 which is integrally connected to the frangible skirt portion 16 and is of a relatively stiff section.

It will also be apparent that the height of the handle 17 is reduced adjacent the connection of the handle to the frangible skirt portion as at 27. Finally, it will be seen that the joint between the leg 26 and the frangible skirt portion 16 has an upper edge which slopes circumferentially and axially upwardly to the left towards the line of weakening 18, as indicated at 28. The net result of the beam construction and its connection between the handle 17 and the frangible skirt portion 16 is that a radially outwardly and axially upward pull on the handle 17 will concentrate a rupturing force on the lower edge of the skirt 15 at the lower end of the weakening line 18 so that tearing will initiate at the lower edge of the skirt 15 and continue across the full height of the skirt 15 for the height of the line of weakening 18.

After the skirt 15 has been ruptured along the line of weakening 18, a further radially outward pull on the handle 17 will result in the rupture of the frangible skirt portion 16 along the weakening line 20 with the skirt separating from the crown body along the weakening line 20 until the reinforcing rib 21 is reached. If desired, at this time one's grip may be transferred from the handle 17 to the frangible skirt portion 16 which is now in the form of a strap so as to facilitate the pulling of a lid from an associated container neck finish. To this end the exterior of the frangible skirt portion 16 may be provided with a plurality of radially outwardly directed upstanding ribs 30, as is best shown in FIG. 1.

It is also pointed out at this time that the line of weakening 20, which is formed by the skirt 15 being radially outwardly offset from the crown body 13, is formed without there being any undercut in the lid which would require a radially outwardly directed rib on the male portion of a mold for forming the lid, thereby eliminating any interlock of a type which would make it difficult to remove the lid from an injection mold in which it is molded.

Figure 2:
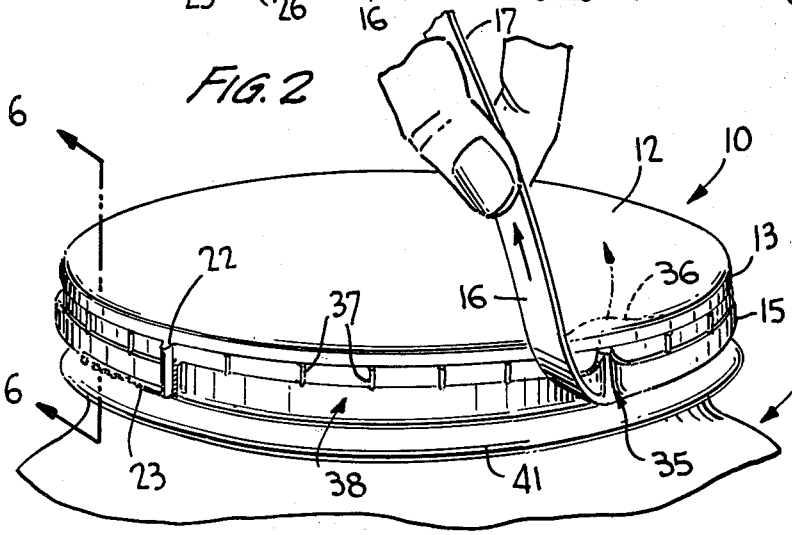
FIG. 2 is a top perspective view of the lid of FIG. 1 on a reduced scale showing the lid applied to a container and in an intermediate step of removal from the container.

Reference is now made to FIGS. 1 and 2 wherein it will be seen that the skirt 15 is reinforced at the end of the frangible skirt portion 16 disposed remote from the weakening line 18. The reinforcement is an external reinforcement and includes an axially extending rib 31 which extends the full height of the skirt 15 and also across at least a lower part of the crown body 13. In addition to the rib 31, the skirt 15 is built up by a gradual thickening of material as at 32 on both sides of the rib 31. This thickening material 32 merges upwardly from the top of the skirt 15 to an intermediate portion of the rib 31 as at 33.

Referring now to FIG. 2 in particular, it will be seen that after the frangible skirt portion 16 has been separated from the adjacent crown body portion, it is now used as a strap to effect the removal of the lid 10 from an associated container 34 which will be described in more detail hereinafter. A generally upward pull on the frangible skirt portion 16, in association with the reinforcement described above and generally identified by the numeral 35, results in a radially outward bowing of the crown body 13 together with an upward bowing of the lid 10 generally in the area defined by the dotted line 36. This results in the radial outward displacement of the locking bead 14 relative to the neck finish of the container 34 in the area of the reinforcement 35, after which the lid 10 may be peeled from the container 34.

At this time it is pointed out that the crown body 13 may be reinforced against displacement from its cylindrical configuration by circumferentially spaced, axial reinforcing beads 37 which are disposed externally of the crown body 13.

Reference is now made to FIG. 6 wherein the lid 10 is applied to a neck finish of the container 34. The neck finish is generally identified by the numeral 38 with the illustrated container 34 being molded of a suitable plastic material although the use of the lid 10 is not so limited. The neck finish 38 includes a cylindrical base portion 40 which is preferably above a radially outwardly directed bead 41. The cylindrical base portion 40 may be provided at an upper end thereof with a radially outwardly directed bead 42 and then includes a tapered generally frustoconical portion 43. The tapered portion 43 terminates in another cylindrical portion 44 which is of a smaller diameter than the base portion 40.

The upper part of the neck finish 38 is in the form of a crown head 45 which defines at the underside thereof a locking shoulder 46 and terminates at the upper end thereof in an end wall 47 which defines a dispensing opening 48.

The original shape of the lid 10 is illustrated in FIG. 6 in dotted lines and in solid lines in its expanded, as applied configuration. First of all, it is to be noted that the crown head 45 has an outer surface of a radius $R_1$ which is greater than a radius $R_2$ of the inner surface of the crown 11 when the lid 10 is initially formed. Secondly, while the skirt 15 of the lid does flare radially outwardly slightly, it is initially primarily cylindrical.

Figure 3:
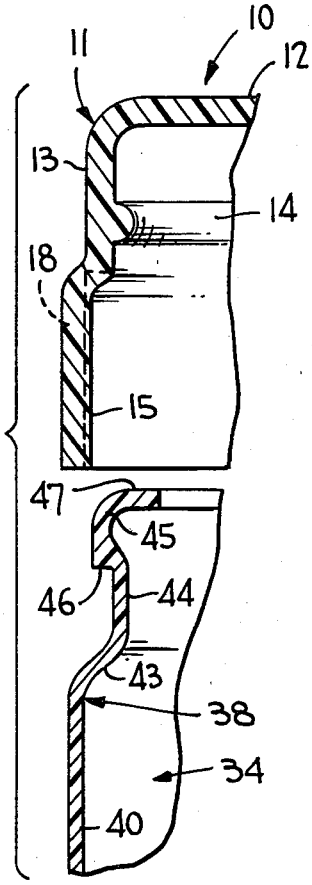
FIGS. 3, 4 and 5 are sectional views through the lid and a container neck finish and schematically show the manner in which the lid is applied to a container neck finish and the deformation of both the lid and container neck finish.
Figure 4:
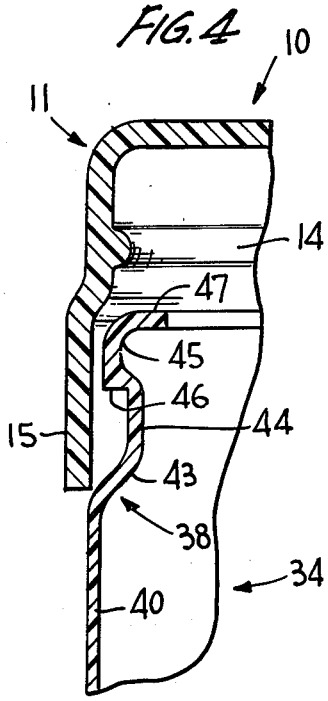

With reference to FIGS. 3, 4 and 6, it will be readily apparent that the skirt 15 readily slips over the crown bead 45 with the lower end of the skirt resting on the lower portion of the neck finish 38. Then a downward force on the lid 10 simultaneously pushes the locking bead 14 under the crown head 45 and below the locking shoulder 46, distorting the whole crown area of the crown 11 and at the same time pushing the skirt 15 over the lower portion of the neck finish 38 radially outwardly distorting the skirt 15. When the neck finish 38 includes the bead 42, as illustrated in FIG. 6, the skirt 15 will assume an outwardly bowed configuration as at 50.

Inasmuch as the crown bead radius $R_1$ is greater than the radius $R_2$ of the internal surface of the crown 11, it will be seen that the crown 11 is radially outwardly deformed and is tensioned, thereby drawing the locking bead 14 axially upwardly so as to compressively engage beneath the shoulder 46. In this manner the lid or closure cap 10 is assured a tight seal with the neck finish 38. It will also be apparent that the end panel 12 is pulled tightly against the upper surface of the end wall 47 to further form a seal.

Figure 5:
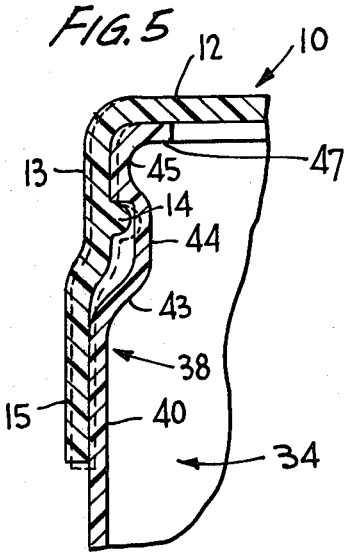

It will also be apparent from FIGS. 5 and 6 that due to the outward expansion of the skirt 15, there is an interference fit between the skirt 15 and the neck finish 38 tightly holding at least a bottom part of the skirt 15 against the exterior surface of the neck finish 38 and forming a seal against the entrance of foreign matter between the lid 10 and the neck finish 38. This seal is particularly enhanced when the neck finish 38 is provided with the radially outwardly directed bead 42 as shown in FIG. 6 although the seal will exist even when the lower part of the neck finish 38 is completely cylindrical, as is schematically illustrated in FIGS. 3–5.

It will also be apparent that when the container 34 is provided with a radially outwardly directed bead 41 immediately below the neck finish 38, there will be relatively small clearance for foreign matter to accumulate. At the same time, this small clearance substantially prevents the use of a prying tool to open the container without utilizing the handle 17 and the frangible skirt portion 16.

It is also pointed out here with respect to FIG. 4, even though the skirt 15 freely passes downwardly over the crown portion 45 of the neck finish 38, the lid 10 will not necessarily move downwardly over the neck finish 38 uniformly, but may have a tendency to slightly tilt. This will increase the interference fit between the skirt 15 and the lower portion of the neck finish 38 on the high side of the skirt 15. However, the skirt 15 will sufficiently radially outwardly deform to compensate for this occurrence.

Figure 10:
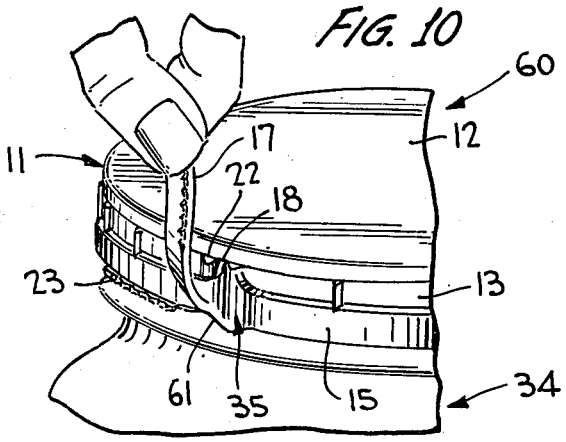
FIG. 10 is a fragmentary top perspective view of a slightly modified form of lid wherein the frangible skirt portion is defined solely by the axial line of weakening.

Reference is now made to FIG. 10 wherein there is illustrated a modified form of lid or closure cap generally identified by the numeral 60. The lid 60 is identical with the lid 10 and differs therefrom only in that the circumferential line of weakness 20 is eliminated. Thus the resultant frangible skirt portion 61 is defined solely by the axial weakening line 18. Further, the frangible skirt portion 61 is substantially in its entirety between the axial weakening line 18 and the reinforcement 35 which has been moved to a location almost immediately adjacent the weakening line 18. The lid 60 otherwise does not differ from the lid 10 except for the elimination of the ribs 30.

In the removal of the lid 60 from the container 34, for example, the handle 17 is gripped and torn from the web 23. The handle is then pulled upwardly and in a single motion the skirt 15 is ruptured along the weakening line 18 and is deformed so as to permit a radially outward bowing of the crown body 13 to release the locking bead 14 from beneath the shoulder 46 in the manner described with respect to the removal of the lid 10 from the container 34.

It is to be understood that the lids 10 and 60 may beneficially be formed of polypropylene as compared to the present use of low density polyethylene in the forming of crown lids of the general type to which this invention relates. By using this stiffer, harder and tougher material, it will be seen that the desired seals with the neck finish of the container 34 may be obtained without an undue permanent flow deflection of the material of the lid and, therefore, both a retention of the seal during shipping and storage and a resealing of the lid with the container providing a seal with the same integrity of the original seal can be obtained even though a portion of the skirt 15 has been ruptured.

It is also pointed out here that with the frangible skirt portion arrangement of FIG. 10, the strap-like effect of the frangible skirt portion 16 is eliminated and when the lid is used to reseal the container, the lid has a neater appearance.

Although only two preferred embodiments of the invention have been specifically illustrated and described herein, it is to be understood that minor variations may be made in the lid construction without departing from the spirit and scope of the invention as defined by the appended claims.

I claim:

1. A tamper proof lid, said lid comprising a crown having a depending annular body with means for interlocking with a container neck finish, said annular body having depending therefrom a lower skirt incorporating a frangible portion, a handle secured to said frangible skirt portion and having a major part of its length extending in a generally circumferential direction coextensive with a radially adjacent portion of said skirt, said frangible skirt portion when separated from the remainder of said lid forming a lid removing pull strap.

2. A lid according to claim 1 wherein said frangible skirt portion is defined by an axial weakening line adjacent its connection with said handle and in overlapping relation to said handle, and a circumferential weakening line extending from said axial weakening line.

3. A lid according to claim 2 wherein said skirt and said crown body have a reinforcement adjacent said axial weakening line on the side thereof remote from said frangible skirt portion.

4. A lid according to claim 2 wherein the circumferential extent of said circumferential weakening line is on the order of 45 degrees.

5. A lid according to claim 2 wherein said annular body and said skirt have a reinforcement at an end of said circumferential weakening line remote from said axial weakening line.

6. A lid according to claim 5 together with grip facilitating means on an external surface of said frangible skirt portion.

7. A lid according to claim 5 wherein said reinforcement is a circumferentially extending internal rib circumferentially aligned with said circumferential weakening line.

8. A lid according to claim 5 wherein said reinforcement is an axially extending external rib extending transversely of and across said circumferentially extending weakening line.

9. A lid according to claim 8 wherein said axially extending rib is reinforced in the area of said skirt to provide a leverage action in said skirt at the end of said frangible skirt portion to convert an axially upward pull on said frangible skirt portion into a radially outwardly prying force.

10. A lid according to claim 9 wherein said skirt gradually increases in radial thickness towards said axially extending rib.

11. A lid according to claim 9 wherein said axially extending rib extends along said body across and above said means for interlocking with a container neck finish.

12. A lid according to claim 11 wherein said skirt gradually increases a radial thickness towards said axially extending rib.

13. A lid according to claim 11 wherein said skirt gradually increases in radial thickness towards said axially extending rib with said radial thickness tapering upwardly towards and terminating in said rib in said crown.

14. A lid according to claim 11 wherein said skirt gradually increases in radial thickness towards said axially extending rib with said radial thickness tapering upwardly towards and terminating in said rib in said crown generally in alignment with said means for interlocking with a container neck finish.

15. A lid according to claim 1 wherein said handle is radially outwardly offset relative to said skirt and is joined to said frangible skirt portion by a beam portion to facilitate initial rupture of said skirt.

16. A lid according to claim 15 wherein said beam portion is connected to lower part of said handle and is of a lesser height than said handle to apply a rupture initiating force along a lower edge portion of said skirt.

17. A lid according to claim 1 wherein said lid is formed of polypropylene.

18. A lid according to claim 1 wherein said frangible skirt portion is defined by an axial weakening line.

19. A lid according to claim 18 wherein said annular body and said skirt have a reinforcement on the side of said axial weakening line where said handle is secured to said skirt.

20. A lid according to claim 19 wherein said reinforcement is an axially extending external rib extending transversely of and across a circumferentially extending weakening line.

21. A lid according to claim 19 wherein said skirt and said crown body have a reinforcement adjacent said axial weakening line on the side thereof remote from said frangible skirt portion.

22. A lid according to claim 1 wherein said means for interlocking with a container neck finish being in the form of a radially inwardly directed rib disposed adjacent said crown and spaced below an end panel of said crown a preselected distance, and said crown having a lesser internal diameter than the intended container finish wherein when said lid is applied to an intended container said crown will be radially outwardly expanded and axially foreshortened to draw said rib axially under a shoulder of the container neck finish.

23. A lid according to claim 1 together with a container neck finish of the type including a crown bead terminating in an end wall, said neck finish being of a reduced diameter below said crown bead to define a downwardly facing shoulder, said means for interlocking with a container neck finish is in the form of a radially inwardly directed rib disposed adjacent said crown and spaced below an end panel of said crown a preselected distance, and said crown having a lesser internal diameter than said crown bead; and said lid being applied to said container neck finish with said end panel being seated on said end wall, said crown being radially outwardly expanded, and said rib being drawn axially towards said end panel and in axially compressed engagement with said shoulder.

* * * * *